US008162736B2

(12) United States Patent
Brennan

(10) Patent No.: US 8,162,736 B2
(45) Date of Patent: Apr. 24, 2012

(54) PROGRESSIVE JACKPOT SYSTEM

(75) Inventor: James William Brennan, Melton (GB)

(73) Assignee: Arrow International, Inc., Cleveland, OH (US)

( * ) Notice: Subject to any disclaimer, the term of this patent is extended or adjusted under 35 U.S.C. 154(b) by 1014 days.

(21) Appl. No.: 12/121,169

(22) Filed: May 15, 2008

(65) Prior Publication Data

US 2008/0300052 A1 Dec. 4, 2008

Related U.S. Application Data

(60) Provisional application No. 60/932,297, filed on May 30, 2007.

(51) Int. Cl.
*A63F 9/24* (2006.01)

(52) U.S. Cl. ..... 463/16

(58) Field of Classification Search ..... 463/16, 463/19, 25–30

See application file for complete search history.

(56) References Cited

U.S. PATENT DOCUMENTS

| | | | | |
|---|---|---|---|---|
| 6,565,091 | B2 * | 5/2003 | Weingardt | 273/269 |
| 6,634,946 | B1 * | 10/2003 | Bridgeman et al. | 463/28 |
| 7,753,782 | B2 * | 7/2010 | Cuddy et al. | 463/26 |
| 7,959,509 | B2 * | 6/2011 | Saffari et al. | 463/27 |
| 2002/0117803 | A1 * | 8/2002 | Weingardt | 273/269 |
| 2005/0187014 | A1 * | 8/2005 | Saffari et al. | 463/27 |
| 2006/0205468 | A1 * | 9/2006 | Saffari et al. | 463/16 |

* cited by examiner

*Primary Examiner* — Masud Ahmed
(74) *Attorney, Agent, or Firm* — Fay Sharpe LLP

(57) ABSTRACT

A method for playing a game of chance includes distributing game cards from a set of game cards to a plurality of players, each of the game cards in the set displaying at least one game face which includes a set of indicia selected from a pool of indicia. A game of chance is played in which the players match indicia randomly called from the pool of indicia with the indicia in the respective game face. A game face is identified in which a set of the called indicia form a first configuration on a game card from the plurality of distributed game cards. A jackpot level is determined from a plurality of possible jackpot levels based at least in part on a comparison of at least one of the indicia displayed on the identified game face with at least one jackpot number. A game face with a winning game configuration is identified and a determination made as to whether the game face with the winning game configuration qualifies for a jackpot award at the determined level, based at least in part on one of the indicia of the winning game face.

15 Claims, 5 Drawing Sheets

PROGRESSIVE JACKPOT SYSTEM

This application claims the priority of U.S. Provisional Application Ser. No. 60/932,297, filed on May 30, 2007, and the disclosure of which is incorporated herein in its entirety by reference.

BACKGROUND

The present exemplary embodiment relates to the gaming arts. It finds particular application in conjunction with a bingo-type game, and will be described with particular reference thereto. However, it is to be appreciated that the present exemplary embodiment is also amenable to other games, such as keno, or the like.

Bingo is a popular game of chance in which cards from a set are distributed to players. Each card displays at least one bingo face, which consists of a matrix of numbers. Numbers are announced or "called" from a fixed pool of numbers that are used in the game, e.g., the numbers 1-90 in a 90 number ticket. Each bingo face includes a subset of these numbers. In one type of bingo face, the numbers are arranged in columns and rows (or "lines"). Each column represents numbers in the units, tens, twenties, etc. Thus, for a typical 90 number ticket, nine columns are used. Each line typically includes five numbers. Another type of bingo face is a 5×5 matrix, with each column of numbers listed under a letter of the word "bingo." The numbers are labeled B1-B15, I16-I30, N31-N45, G46-G60 and O61-O75. For example, under the letter "B," five unique numbers selected from a subset of the numbers, 1 through 15 may be listed, and so forth.

There are many different types of bingo games. In one type of game, all of the numbers are drawn for the game before any players view the arrangement of numbers on their bingo cards. The award is a predetermined amount. After the draw occurs, the players may purchase cards and compare the arrangements on the cards to the drawn numbers to determine whether one or more game-winning or other predetermined patterns are matched.

In live bingo games, the game is typically played by marking or filling in a bingo face as corresponding numbers are called from the pool. The numbers are called in a generally random or pseudo-random fashion. In some games, each of those numbers is represented by a ball in a large rotating bin. Each ball has a unique one of the bingo numbers. The bin is rotated and one of the balls is randomly selected. The number of the selected ball is announced (and sometimes displayed) to the players. The players check each of their bingo cards to see if the announced number appears on the card. If the number appears on a card, the player marks (or daubs) the card, using an item such as a bingo marker. When a player achieves a designated winning combination or pattern such as a 1 line (five marked spots in a row), a 2 line (two lines, each with five marked spots in a row), a "full house" (also known as "cover-all"), in which all of the numbers in the bingo face are marked, or other designated combination, the player is a winner if that player is the first person to achieve and announce such combination. This is often done by the person calling out "Bingo."

The award for a typical Bingo game is relatively small and depends on the number of players and the organizer's profit margin. To add excitement to the game, it would be advantageous for players to have the chance of winning a larger award, with the costs of that award being shared over multiple games.

BRIEF DESCRIPTION

In accordance with one aspect of the exemplary embodiment, a method for playing a game of chance is provided. The method includes distributing game cards from a set of game cards to a plurality of players, each of the game cards in the set displaying at least one game face which includes a set of indicia selected from a pool of indicia. A game of chance is played in which the players match indicia randomly called from the pool of indicia with the indicia in the matrix of the respective game face. A game face is identified in which a set of the called indicia form a first configuration on a game card from the plurality of distributed game cards. A jackpot level is determined from a plurality of jackpot levels based at least in part on a comparison of at least one of the indicia displayed on the identified game face with at least one jackpot number. A game face with a winning game configuration is identified. A determination is made as to whether the game face with the winning game configuration qualifies for a jackpot award at the determined level, based at least in part on one of the indicia of the winning game face.

In another aspect, a computer program product encodes instructions, which when executed on a computer, stores information on a plurality of game faces in play in a game of chance, each of the game faces comprising an arrangement of indicia selected from a pool of indicia, calls indicia randomly from the pool of indicia, determines when a first configuration of the called indicia is present on one of the game faces, generates jackpot indicia, compares the jackpot indicia with at least one of the indicia on the game face in which the first configuration is present, determines a jackpot level from a plurality of jackpot levels based at least in part on the comparison, and determines whether a game face with a winning game configuration is to receive a jackpot award at the determined jackpot level.

In another aspect, a gaming apparatus includes a control unit which stores information on a plurality of game faces in play in a game of chance, each of the game faces comprising an arrangement of indicia selected from a pool of indicia, calls indicia from the pool of indicia, determines when a first configuration of the called indicia is present on one of the game faces, generates jackpot indicia, compares the jackpot indicia with at least one of the indicia on the game face in which the first configuration is present, determines a jackpot level from a plurality of jackpot levels based at least in part on the comparison, and determines whether a game face with a winning game configuration is to receive a jackpot award at the determined jackpot level. A display displays the determined jackpot level.

DETAILED DESCRIPTION

Figure 1:
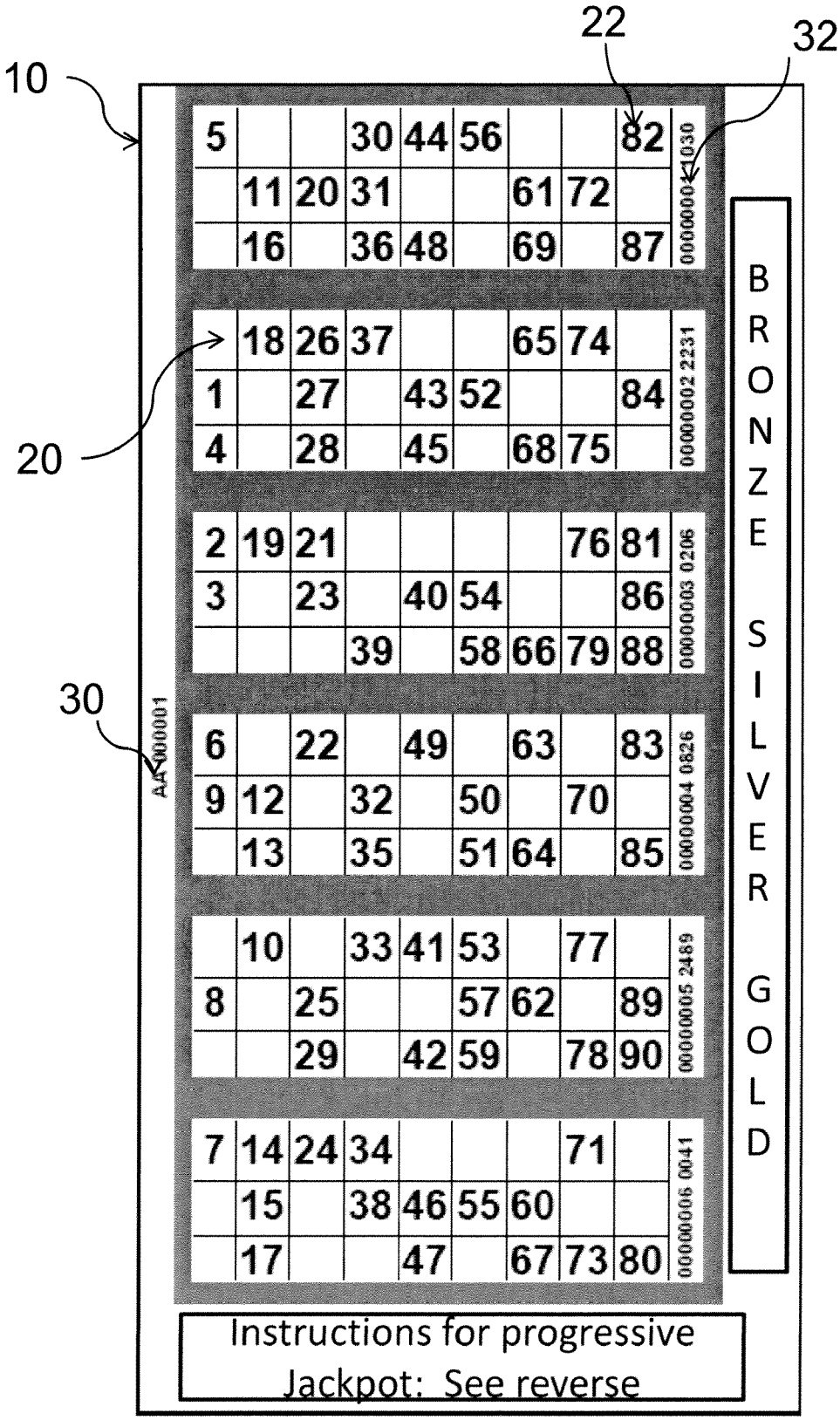
FIG. 1 is a top plan view of an exemplary ticket for use in a game of chance in accordance with one aspect of the exemplary embodiment.

While this disclosure is susceptible of embodiment in many different forms, there is shown in the drawings and will herein be described in detail, several embodiments of the disclosure. However, it should be understood that the Figures are to be considered only as exemplifying the principles of the instant disclosure and are not intended to limit the disclosure to only the embodiments illustrated.

Aspects of the exemplary embodiment relate to a method for playing a game of chance in which a jackpot level is determined during the game by matching randomly called numbers to numbers on one of the tickets in play. The exemplary game of chance may be played with any suitable set of tickets of the type normally used in playing a Bingo-type game. Specially printed tickets are not required, although in one embodiment, the operation of a method for determining a jackpot level in accordance with the exemplary embodiment may be described on or in association with the ticket for the players' convenience.

With reference to FIG. 1, an exemplary game card in the form of a bingo card or ticket 10 is illustrated for ease of understanding the exemplary embodiment. Bingo card 10 is intended as exemplary, in that the present game system includes a substantial number of such cards. In one embodiment, for example, about 100 or 500 or more bingo cards are employed in playing the game. Each of the bingo cards 10 is purchased by a game player for a nominal sum, such as £1 or $1. The cards 10 may be packaged as a set, in a suitable wrapping (not shown).

As shown in FIG. 1, each bingo card 10 displays at least one bingo game face 20. Each bingo face comprises a different pattern of game indicia 22, such as numbers and/or letters. Other known indicia, such as stars, bells, geometric figures, or the like could also be used. In the illustrated embodiment, the indicia 22 will be referred to for convenience as numbers, although it is to be appreciated that other uniquely distinguishable characters or groups of characters may be employed in place of numbers.

In one embodiment, each bingo face pattern is in the form of a matrix. In the illustrated matrix, each vertical column is associated with numbers in the units, tens, twenties, etc, respectively. Each horizontal row (referred to as a line) includes the same number of bingo numbers, five bingo numbers in the illustrated embodiment. The matrix includes spaces as well as numbers 22. In the illustrated embodiment of a bingo face 20, a 9×3 is employed, often referred to as a 90-number ticket, since the numbers 22 are selected from the numbers 1-90. For this matrix, nine columns of three number locations each are employed. Thus, twenty-seven bingo numbers could be used in this matrix. However, to speed up play, each bingo matrix only uses fifteen numbers. These, as can be seen from FIG. 1, can be randomly distributed in the twenty-seven number blocks. But, the numbers 1 to 9 would only appear in the first column, and so on. In another embodiment, the ticket may be an 80-number ticket, in which case, the face may have eight columns instead of nine. Or, there may be fewer or more than five numbers 22 in each row.

In other embodiments, the matrix may be an N×M matrix where each location includes a number 22. For example, the matrix may be a 5×5 matrix in which each of the letters of the word BINGO are used to designate the columns. Under the letter "B", five unique numbers selected from 1 through 15 may be listed, and so forth. In this embodiment, the numbers 1 to 75 are employed. Several other bingo matrices are also popular. It should be appreciated that the game of chance discussed herein could be used with any desired bingo matrix of N×M numbers, such as 3×3, 4×4 and so on.

The game numbers 22 in the matrix are selected from a pool of numbers, such as the numbers 1 to 70, 1 to 75, 1 to 80, 1 to 90, or the like. In the illustrated embodiment, the bingo cards are configured for use with a ninety number pool. Each of the bingo faces 20 may thus include some, but not all, of the numbers between 1 and 90, inclusive. As with a conventional bingo game, no number is represented more than once in a given bingo face 20. Each bingo face 20 in the set of bingo cards (or among those bingo faces which are designated for use in the same game, where cards have multiple bingo faces) may have a unique subset of numbers from the pool represented in the bingo face 20, i.e., no two bingo faces have an identical set of numbers. This reduces the chance of multiple winners, which is disfavored by players.

Each bingo card 10 may be printed with a unique identifier, such as a serial number 30, which may be used to identify the set of tickets to which it belongs. Similarly, each bingo face 20 may also have associated therewith a unique identifier 32, which distinguishes that bingo face from other bingo faces on the same, and other, bingo cards in the set. Also, an identifier may distinguish a particular bingo card from bingo cards in other sets. In general, each bingo face 20 in the set of bingo cards is thus associated with its own unique serial number 32. Other methods of uniquely identifying the bingo card/bingo face, such as by color, other marks, a combination of a serial number and color, or a bar code are also contemplated.

Figure 2:
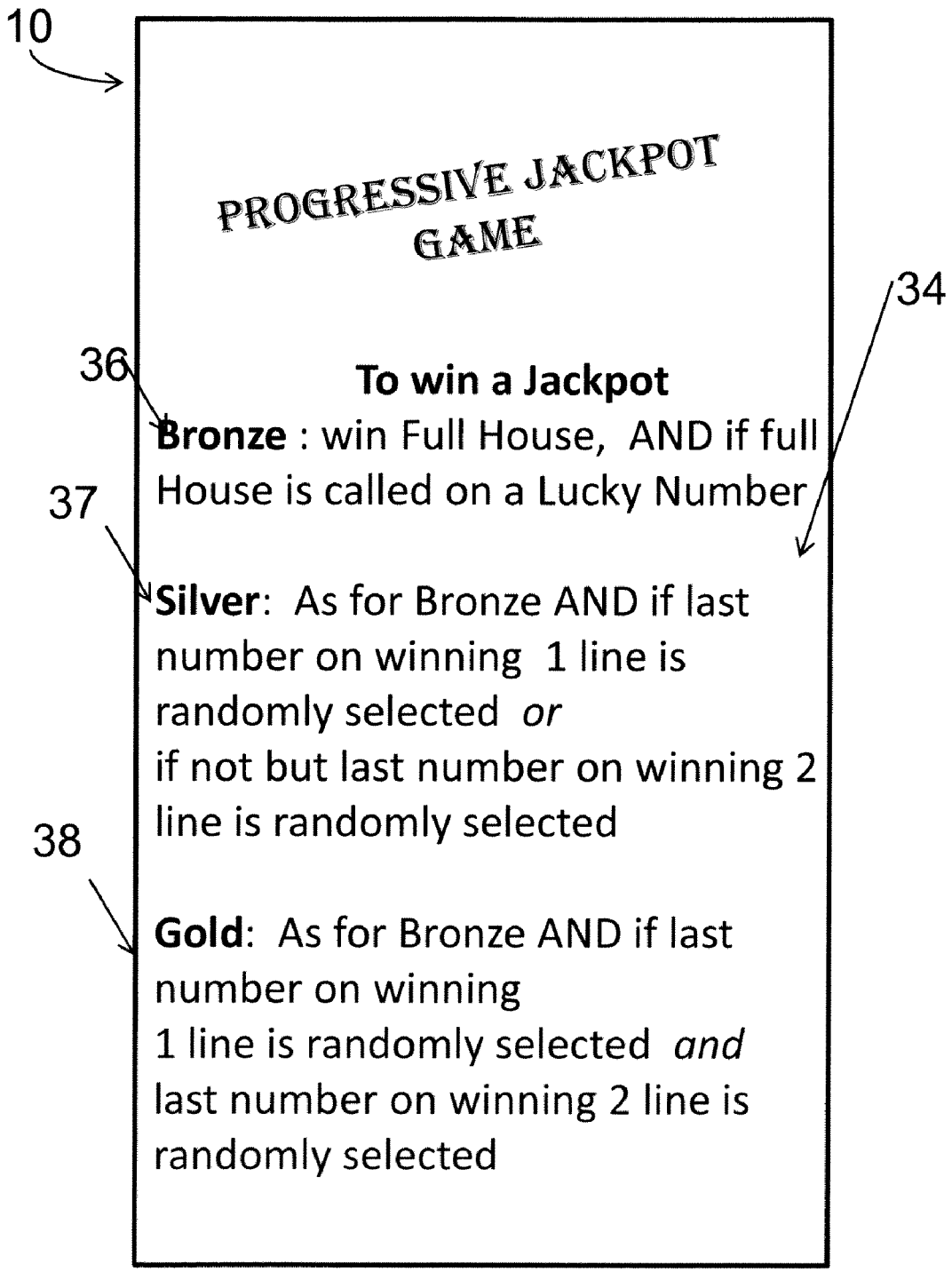
FIG. 2 is a bottom plan view of the ticket of FIG. 1.

The bingo tickets 10 may be in physical form, e.g., formed from paper, card stock, or other suitable print media, with the displayed bingo face (or several bingo faces) 20 and serial number(s) 30, 32 printed or otherwise marked on one side of a piece of print media. Rules 34 for determining a jackpot level 36, 37, 38 may be printed on the other side of the card 10, as illustrated in FIG. 2. In another embodiment, the bingo tickets are in electronic form and are displayed to the respective player as a representation on a screen of a bingo gaming device, which may also display the rules 34, as described in further detail below.

The bingo faces 20 are used in playing a game of chance, namely, a bingo game, in which a game organizer calls numbers randomly from the pool and the bingo card holders mark or daub their bingo cards according to the numbers called. An object for each of the players is to be the first to complete a predetermined game winning configuration on one of the bingo faces and thereby have a winning bingo card. In the exemplary embodiment, an object is to have a FULL HOUSE (cover all) on one of their bingo cards 10, which occurs when every number on the bingo face 20 has been called. However, it is to be appreciated that in other embodiments, other configurations may be selected for identifying a winning bingo card, such as configurations where only one or only two lines are covered or where a configuration such as a "T" or "X" configuration of numbers or a "picture frame" (i.e., only the numbers on the outer periphery of the bingo face) is covered.

To add excitement to the game, provisions are made in the playing of the game for players to have a chance of winning a jackpot award at one of a plurality of jackpot levels. The level of the jackpot award is determined during the game, such that players do not know, prior to the start of the game, what the jackpot level will be. In the illustrated embodiment, three jackpot levels 36, 37, 38 are designated Bronze, Silver, and Gold, respectively. The jackpot award may be a monetary award or another sort of prize. The value of the jackpot award generally increases with the level of the award. For example, the Bronze jackpot award may be $50 (or £50), the Silver jackpot award $100, and the Gold jackpot award $500. As will be appreciated there may be fewer or more than three jackpot levels, such as two, four, or more, and their values may be of any suitable amount.

In the exemplary embodiment, designated configurations which are achieved during play, prior to announcement of a winning configuration, are used to provide a means of selecting a jackpot level 36, 37, 38. In one embodiment, a player completes a "1 Line" (first configuration) in the bingo game when all of the five bingo numbers in any one of the horizontal rows of a bingo face is covered (called). The player completes "2 Line" (second configuration) when any two rows in a same bingo face are covered/called. However, other first and second configurations are contemplated, such as a completed column, completed diagonal, "T" or "X" configuration (e.g., in the case of a 5×5 matrix). Indeed the first and second configurations can each be any designated pattern of numbers requiring fewer than all the numbers 22 on a bingo face 20 to be covered. In general, the first configuration requires a smaller subset of the numbers 22 on the bingo face to be covered than the second configuration.

In one embodiment, the determination of the jackpot level 36, 37, 38 may be determined progressively during the game, with an increase in the jackpot level being contingent on a particular outcome when the 1 Line and 2 Line calls are made (or other predetermined first and second configurations are achieved). The jackpot level may be set at the Bronze level by default. The jackpot level can be elevated to the Silver level based on a match between one or more randomly drawn numbers (jackpot numbers) and one or more of the numbers on the winning 1 Line bingo face or winning 2 Line bingo face. In general, the award level is progressively raised by no more than one level at a time, such that to reach the Gold level, a match must be made for both the winning 1 Line ticket and the winning 2 Line ticket. By "match," it is meant that the two indicia are the same or are recognized as being the same.

The jackpot numbers may be drawn from a set of numbers forming a subset of the numbers found on the ticket with the winning first or second configuration. In particular, the jackpot numbers may be drawn from a set which includes some or all of the numbers on the respective 1 Line or 2 Line winning ticket, such as only the numbers which form the 1 Line or 2 Line, respectively. From this set of numbers, the jackpot numbers are drawn at random and compared with one or more numbers on the winning 1 Line or 2 Line ticket to see if there is a match. For example, when the 1 Line winning ticket is identified, m jackpot numbers are randomly drawn from a set of n numbers constituting the 1 Line and where m may be from 1 to n−1. In the illustrated embodiment, n=5, so m may be from 1-4, e.g., 2. The m drawn jackpot numbers are compared with a predetermined one (or more) of the 1 Line numbers, such as the last number of the 1 Line to be called and, if there is a match, the award level is elevated to the Silver level.

Similarly, when the 2 Line winning ticket is identified, p jackpot numbers 22 are drawn from the q numbers constituting all of the numbers on the winning two lines. p may be from 1 to q−1. In the illustrated embodiment, q=10, so p may be from 1-9, e.g., 2. The p drawn jackpot numbers are compared with a predetermined one (or more) of the winning 2 Line numbers, such as the last number of the 2 Line to be called and, if there is a match, the jackpot level is elevated to the next level. Accordingly, if there was also a match at the 1 Line, then the level will be elevated to the Gold level, if not, it is elevated from the Bronze to the Silver level.

Thus, for example, if the holder of the ticket 10 illustrated in FIG. 1 were to be a 1 Line winner with the numbers on the second row on face 20, the jackpot numbers may be drawn from the set of numbers which constitute that row: 11, 20, 31, 61, and 72. For example, two jackpot numbers may be drawn randomly from this set, such as the numbers 20 and 72. If either of these numbers was the last number to be called, the award level is elevated to the Silver level. If not, it remains at the Bronze level until the 2 Line winner is announced.

Additionally, whether or not the jackpot award is made in a particular game may be made conditional on the winning game ticket including one of a set of indicia drawn from the pool, which will be referred to as "lucky numbers." In one embodiment, some or all of the lucky numbers are not known prior to commencement of play such that a player does not know whether a given bingo face includes one or more of the lucky numbers. The set of lucky numbers may include r numbers drawn from the pool during the course of the game. In the illustrated embodiment, r is 4 although fewer or greater number of lucky numbers may be employed, such as from 1-10. In one embodiment, the lucky numbers are drawn from the numbers remaining in the pool once the 2 Line winner has been determined (i.e., from the numbers yet to be called). In general, there are more numbers remaining in the pool that lucky numbers, such that fewer than all of the numbers remaining are drawn as lucky numbers. In general, one of the lucky numbers is required to be present on the winning ticket for the player to receive the jackpot award. For example, the rules may specify that if a player holding a winning game ticket calls on one of the lucky numbers, the holder of the ticket is entitled to claim the associated jackpot award at the jackpot level determined during the course of the game.

Figure 3:
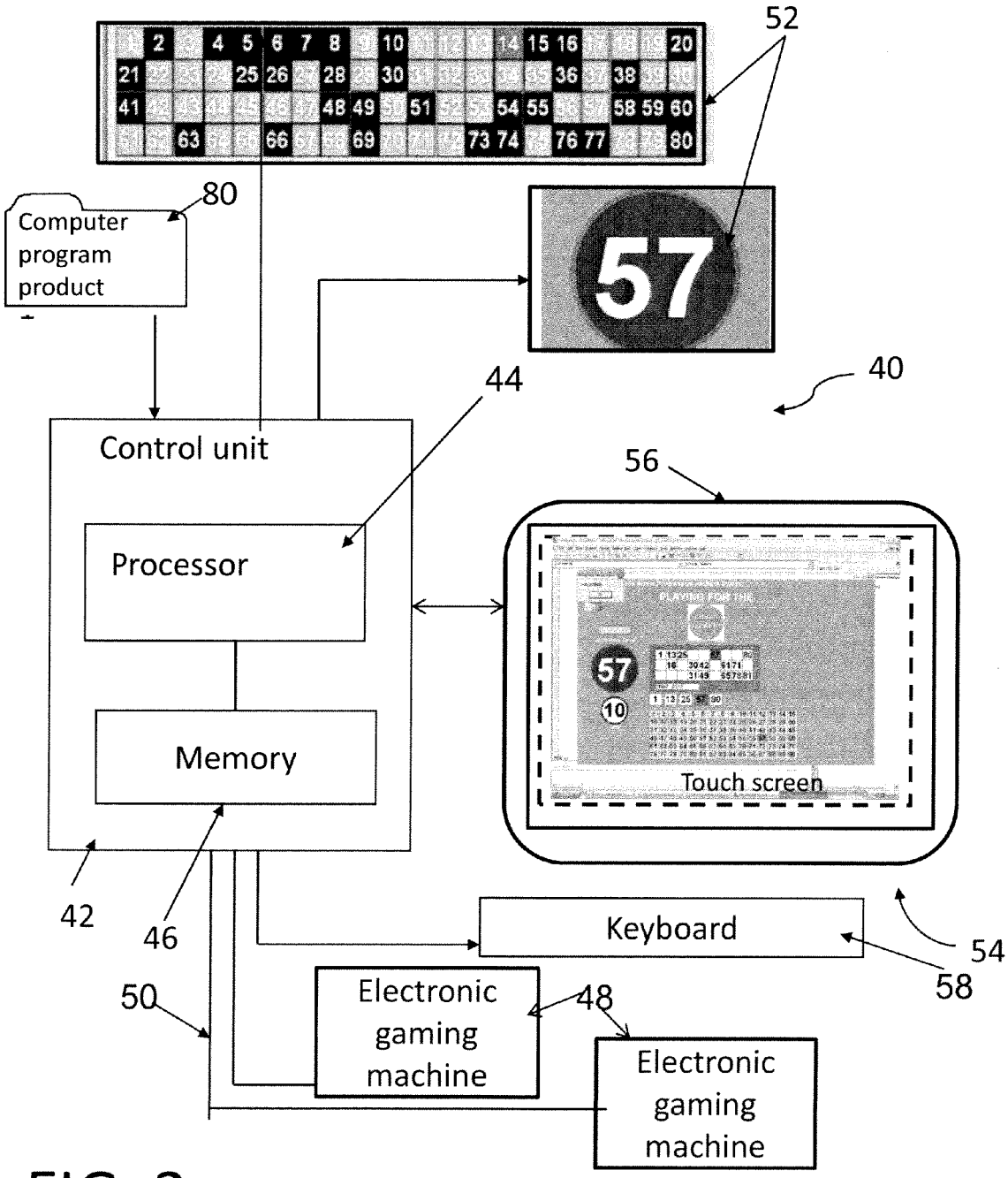
FIG. 3 illustrates an exemplary apparatus for playing a game of chance in accordance with another aspect of the exemplary embodiment.

While the exemplary method is amenable to play with conventional Bingo equipment, such as bin from which numbered balls are drawn randomly, or another random number generator, it is also amenable to systems employing a control unit. By way of example, FIG. 3 illustrates an exemplary apparatus 40 for playing a game of chance. The apparatus 40 includes a control unit 42, which includes a processor 44 for executing the computer implemented steps of the method including generating the calls, identifying the set of numbers from which the jackpot numbers are to be drawn, generating the jackpot numbers, and generating the lucky numbers. The instructions executed by the processor 44 may be stored in associated memory 46. The control unit 42 may be linked to one or more gaming machines 48 by a network 50. The gaming machines 48 may be remote electronic gaming machines, which allow players at different locations to participate in the same game and/or to pool resources for the jackpot awards. In other embodiments, gaming machines 48 may be remote game card dispensing machines which dispense tickets 10. The control unit 42 may be embodied in a computing device that is capable of controlling the functions of the gaming machines 48 (where present) as well as one or more digital flashboards 52. The apparatus 40 may thus facilitate the playing of a live Bingo game at several remote locations.

The bingo cards 10 may be distributed in tangible form or electronically. For example, gaming machines 48 may include a coin or token slot or credit card slot or other payment device which allows a player to purchase tickets and a dispensing device which outputs a printed ticket and/or a display which displays a representation of the purchased bingo ticket(s) 10. In other embodiments, the tickets may be distributed by the game organizer.

In general, the control unit 42 is informed as to which of the possible game faces 20 in the set of unique game faces are in play in a given game and thus is able to identify when one of the game faces has a 1 Line, 2 Line, or winning game configuration. In the case of electronic gaming devices 48 which display a representation of the ticket, this information may be collected automatically. In the case of physical tickets, the game organizer may input the serial numbers 30, 32 of the tickets/game faces in play to the control unit 42. The control unit can then retrieve the arrangement of numbers for each corresponding bingo face 20 from associated memory 46, based on the input serial number.

In the case of electronic gaming machines, the gaming machines 48 may each include a graphical user interface (GUI), including a visual display, such as an LCD screen, and a user input device, such as a keyboard, keypad, touch screen, cursor control device (e.g., a mouse or joystick), or combination thereof. A user operates the GUI to make selections, electronically daub the bingo numbers on the bingo face 20, and electronically announce to the control unit 42 when the player has a 1 Line, 2 Line, FULL HOUSE, or other winning configuration for the game.

Figure 4:
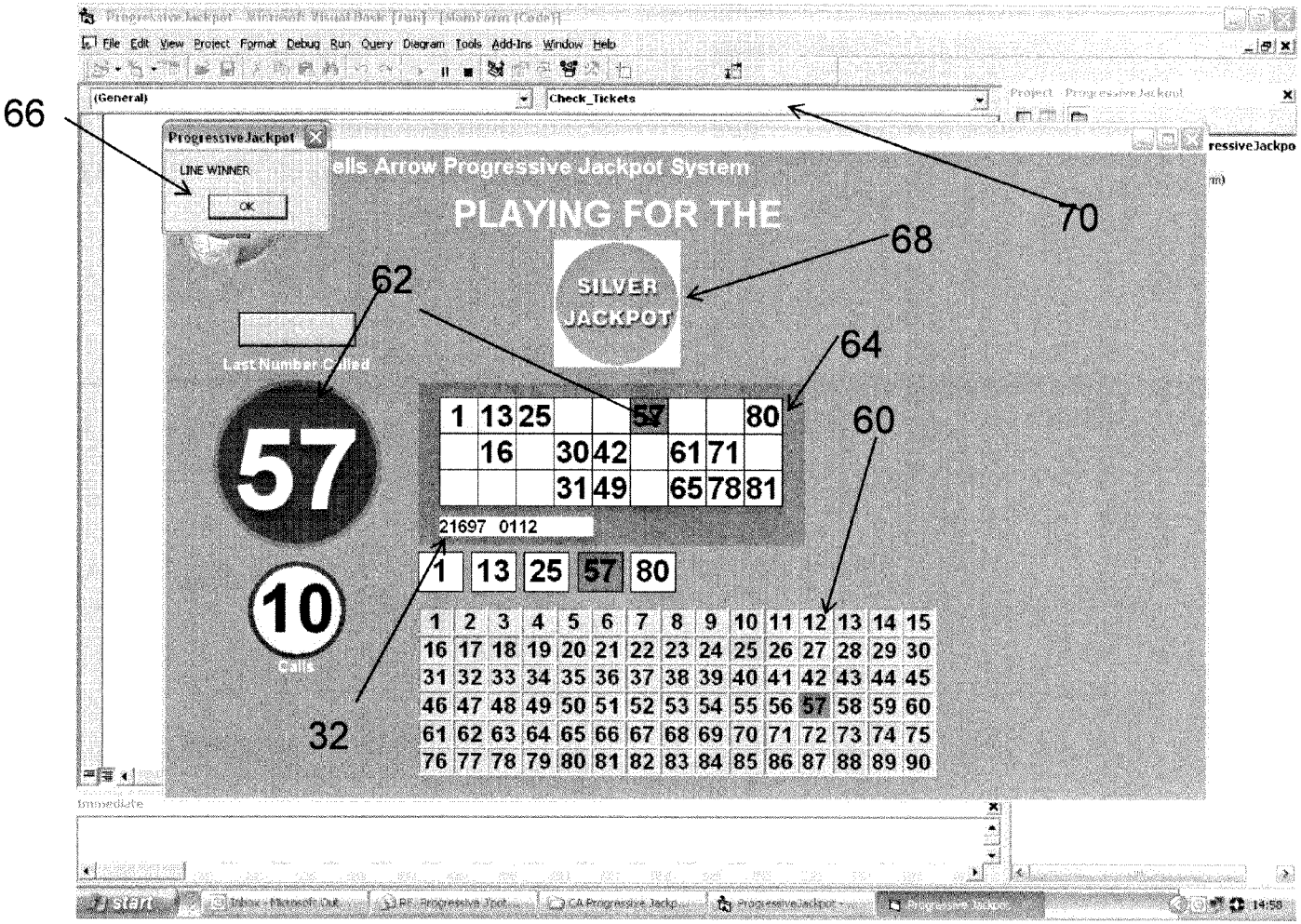
FIG. 4 illustrates a screen shot of a screen of an electronic bingo unit controller in accordance with another aspect of the exemplary embodiment.

The illustrated control unit 42 is linked to a user interface 54 which allows a game operator to follow the progress of the game and identify when there is a 1 Line or 2 Line winners. The user interface may be in the form of a graphical user interface (GUI) which includes a visual display 56, such as an LCD screen, and a user input device 58, such as a keyboard, keypad, joystick, touch screen, or the like. FIG. 4 shows a screenshot of an exemplary user interface display 56 during the playing of a game. In response to instructions from the control unit 42, the user interface displays a representation 60 of the called numbers and may identify the last number called as shown at 62 (here illustrated as the number 57). Additionally, when the control unit determines, based on the calls, that one of the game faces in play has completed a 1 Line or 2 Line, a representation 64 of the respective game face 20 may be displayed, together with its serial number 32. A pop up box 66 may appear when this occurs, giving the game organizer the opportunity to announce the 1 Line winner and/or verify that the ticket is in play. The display 56 may also indicate the jackpot level, as shown at 68, here illustrated as the Silver jackpot level 37. Optionally, an expandable menu 70 allows the operator to enter the serial numbers 30, 32 of the tickets/bingo faces in play, e.g., by entering the first and last serial numbers of the tickets distributed. When the jackpot numbers are generated, these may also be displayed on the screen.

The control unit 42 may be embodied in one or more general purpose computers, special purpose computer(s), a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA, or PAL, or the like. For example, the control unit and user interface may be housed in a common housing of the gaming device 48 or may be embodied in a desktop computer, a laptop computer, a personal digital assistant (PDA), cell phone, MP-3 player or other computerized platform. In some embodiments, components of the control unit 42 are distributed over two or more locations and/or the control unit may be under the control of a remote control system (not shown) which supervises the operations of a plurality of such control units. The control unit may be communicatively linked to the common control system via a network, e.g., via the internet.

The memory 46 may represent any type of computer readable medium such as random access memory (RAM), read only memory (ROM), magnetic disk or tape, optical disk, flash memory, or holographic memory. In one embodiment, the memory 46 comprises a combination of random access memory and read only memory. In some embodiments, the processor 44 and memory 46 may be combined in a single chip.

Instructions for the control unit 42 may be stored on a computer program product 80 (FIG. 3). The exemplary computer program product 80 stores at least a part of a computer program for performing computer implemented steps of the exemplary method. For example, the program provides for distribution of tickets (electronic or paper) to players at the remote gaming machines 48 and/or for retrieving bingo faces from memory, based on the serial numbers of the distributed tickets, the generation of calls with a random number generator, causing the called numbers to be displayed on the gaming machines and/or on a flashboard, and facilitating the verification of the winning bingo card(s) and any jackpot awards. In particular, the computer program product 80 encodes instructions, which may be executed on a computer, for performing the method illustrated in FIG. 5 below. As will be appreciated, modifications may be made to the game whereby not all these operations may be programmed on the computer program product.

The computer program product may be a tangible computer-readable recording medium on which a control program is recorded, such as a disk, hard drive, or may be a transmittable carrier wave in which the control program is embodied as a data signal. Common forms of computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, transmission media, such as acoustic or light waves, such as those generated during radio wave and infrared data communications, and the like, or any other medium from which a computer can read and use.

Figure 5:
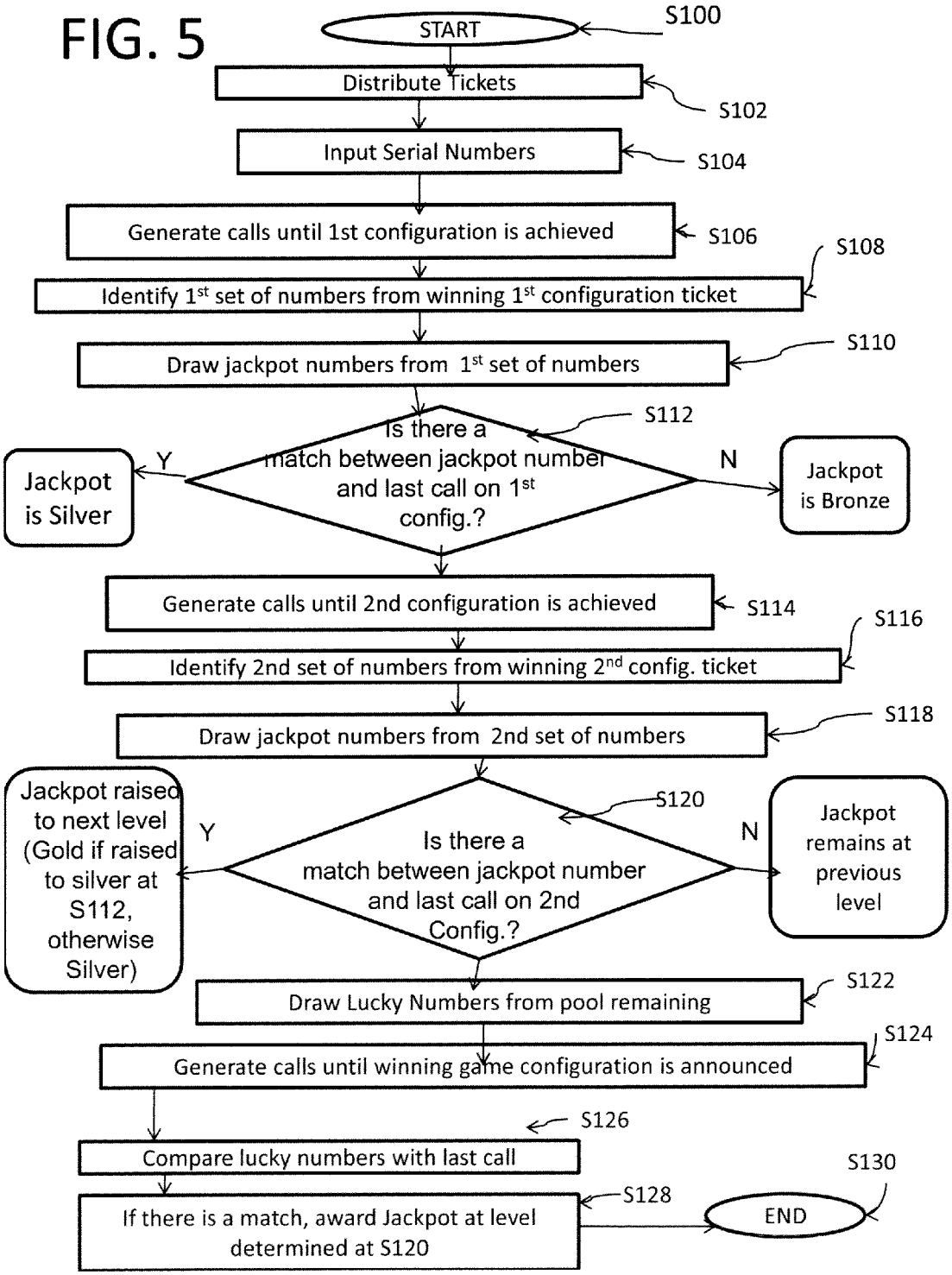
FIG. 5 is a flow diagram which illustrates steps of an exemplary method for playing a Bingo-type game in accordance with another aspect of the exemplary embodiment.

With reference now to FIG. 5, one embodiment of the exemplary method of playing a game of chance is illustrated. As will be appreciated, the method may include fewer, more or different steps from those shown and the steps need not all proceed in the order shown. The method begins at S 100.

The method for playing a game of chance may employ the exemplary bingo cards 10 illustrated in FIG. 1. As noted above, an object for each of the players is to be the first to complete a predetermined winning configuration on the bingo face 20 and thereby have a winning game card. The winner also has a chance of winning a jackpot award, conditional, at least in part, on one of the lucky numbers being present on the winning game face. In the exemplary embodiment, the object is to have a FULL HOUSE (cover all) on one of the bingo faces 20, which occurs when every number on the bingo face 20 has been called. Prior to playing the game, bingo cards 10 are distributed to the players (S102). For example, players may each purchase one or more bingo cards 10 for a nominal sum. The values of the jackpot awards for each of the levels may be displayed, e.g., on the bingo machines or flashboards. In some embodiments, the awards may accumulate in value over time, for example, where no jackpot award is made for a number of games.

At S104, the serial numbers of the distributed tickets may be input to control unit 42, e.g., by manually entering the serial numbers or scanning the tickets, e.g., with a bar code reader.

Once the players have had an opportunity to purchase bingo cards, the game operator initiates the calling of numbers (S106). For example, the numbers are called from the pool, generally in a random or pseudo-random fashion, both of which will be considered random for purposes of the description herein. In some games, each of the numbers in the pool is represented by a ball in a large rotating bin. Each ball has a unique one of the bingo numbers. The bin is rotated and one of the balls is randomly withdrawn. The number of the selected ball is announced to the players, generally either by the game operator and/or by displaying the number on a video screen or manually operated flashboard positioned within view of the players. In other embodiments, the numbers may be generated by the control unit 42, which runs an automated random number generating program.

Each player then checks his bingo cards 10 to see if the announced number appears on any of the bingo faces 20 that are in play. If the number appears on a bingo face in play, the player marks (or daubs) the called number on the bingo face using an item such as a bingo marker, pen, or other marking device.

The calling of numbers is repeated several times, each time allowing the players time to mark their bingo cards. This continues until a player achieves a predetermined first configuration, e.g., a 1 Line. From this, a first set of numbers, from which a first group of jackpot numbers are to be drawn, can be identified (S108). The player achieving the 1 Line may be required to announce the 1 Line and may receive a small award if he is the first to do so. In other embodiments, the game organizer may announce that a 1 Line has been completed. In yet another embodiment, the control unit may cause the bingo units and/or flashboard to announce the completion of a 1 Line, e.g., by displaying a representation of the respective bingo face.

At S110, the first group of m jackpot numbers is randomly drawn from the first set of n numbers forming the first configuration and at S112 a determination is made as to whether any one of these matches the last number called in the 1 Line (the number 57 in the embodiment of FIG. 4). If at S112, there is a match, the Jackpot level is raised to the Silver level. If there is no match, the award level remains at the initial (Bronze) level.

The calling of numbers is repeated one or more times (S114), each time allowing the players time to mark their bingo cards until a player achieves a predetermined second configuration, e.g., a 2 Line. At S116, a second set of numbers is identified from the player's game face 20 from which a second group of jackpot numbers can be drawn. The player achieving the 2 Line may be required to announce the 2 Line and may receive a small award if he is the first to do so. In other embodiments, the game organizer may announce that a 2 Line has been completed. In yet another embodiment, the control unit may cause the bingo units and/or flashboard to announce the completion of a 2 Line, e.g., by displaying a representation of the respective bingo face.

At S118, p numbers are randomly drawn from the q numbers forming the second configuration and at S120 a determination is made as to whether any one of these matches the last number called in the 2 Line. If at S120, there is a match, the jackpot level is raised to the next level. Accordingly, if at S112, the award level was raised to the Silver jackpot, the award level is raised to the Gold jackpot level. If the award level was previously at the Bronze level, it is raised to the Silver level. If there is no match, the award level remains at the previous level (i.e., Silver, if it was raised at step S112, otherwise Bronze).

Before any further calls are made, at S122, r lucky numbers (e.g., 5 lucky numbers) are drawn from the numbers remaining in the pool and may be displayed or otherwise announced to the players. Those players holding a ticket which displays a lucky number on a bingo face then know that they have a chance of winning the jackpot award if they are the first to complete a game winning configuration such as FULL HOUSE (all of the numbers in the bingo face are marked). Calls are generated (S124) until a winning game face is announced. In some embodiments, once a player achieves a designated game winning configuration, the player wins the game. In some embodiments, for a player to win the game, the player must also be the first to announce the game winning configuration, for example, by calling out "BINGO" or "FULL HOUSE." Otherwise, the game may continue with one or more further calls being made until a player announces he has a FULL HOUSE. Of course, the game may end with the first winning bingo face and the game proprietor announcing that fact to the players, who then search their cards for the winning bingo face. In the exemplary embodiment, a player has to win the FULL HOUSE in order to be eligible to win a Jackpot award.

At S126 the lucky numbers are compared with the winning bingo face. If one of the lucky numbers matches a designated number on the winning bingo face, such as the last number to be called, then at S124, the player holding the winning ticket is entitled to claim an award at the previously designated jackpot level, which may be Gold, Silver, or Bronze, depending on the outcomes at S112 and S120. The holder of a winning bingo card 10 would then collect his prize from the game organizer at the appropriate level. The prize may be a monetary award, tickets for another game, or other prize. In the case where no jackpot award is made (e.g., where the lucky number does not match the last call made), the player holding the winning game card may non-the-less be entitled to an award for winning the game. This award may typically be of lower value than for a Jackpot award.

The probability of releasing a jackpot award can be altered to suit the needs of the game organizer. For example, the game organizer may be permitted to change (increase or decrease) the probability that a jackpot will be awarded by modifying the number of lucky numbers drawn. The organizer may be permitted to change (increase/decrease) the probability that the jackpot will be raised to a higher level by modifying the number of jackpot numbers drawn from the set of 1 Line and/or 2 Line numbers.

The exemplary method and system can have several of the following advantages. The method can be adapted to play with a variety of types of ticket and is not limited to the 90-number ticket shown. Tickets need not be specially printed since the game may be played with conventional bingo tickets. Different numbers of jackpot levels can be accommodated. The game is easy for players to understand and track. The game is amenable to play with both electronic and paper tickets. All players holding a game face have an equal chance of winning at the start of play. Players can, of course, increase their chances of winning by purchasing more tickets. For example, in one embodiment, all the possible lucky numbers may be included in a set of six game faces. If a player purchases fewer than six game faces, there is a chance that one or more of the lucky numbers called will not appear on any of the game faces. All players can have a chance of winning the jackpot award until the last number is called on the FULL HOUSE (this assumes they have purchased sufficient tickets for all the lucky numbers to be represented and that the lucky numbers have not all already been called by this time, which is relatively unlikely) This helps to maintain the excitement of the game for all players.

As will be appreciated, variations on the above-mentioned method may be adopted to meet the needs of the game organizer. For example, in some events, club-level awards may also be determined during the course of the game. Additional jackpot awards may be determined in ways other than described herein, e.g., by a random drawing of one of the serial numbers in play or the like.

The instant disclosure has been described with reference to the preferred embodiments. Obviously, modifications and alterations will occur to others upon reading and understanding the preceding detailed description. It is intended that the exemplary embodiment be construed as including all such modifications and alterations, insofar as they come within the scope of the appended claims or the equivalents thereof.

The invention claimed is:

1. A method for playing a game of chance comprising:

distributing game cards from a set of game cards to a plurality of players, each of the game cards in the set displaying at least one game face which includes a set of indicia selected from a pool of indicia;

providing a plurality of jackpot levels including a first jackpot level and at least one elevated level, the at least one elevated level including a second jackpot level;

playing a game of chance in which the players match indicia randomly called from the pool of indicia with the indicia in a matrix of the respective game face;

identifying a game face in which a set of the called indicia form a first configuration on a game card from the plurality of distributed game cards;

after identifying the game face with the first configuration, comparing a predetermined one of the called indicia displayed on the identified game face with a first jackpot number;

providing for raising a jackpot level from the first jackpot level to the second jackpot level if there is a match between the predetermined one of the indicia displayed on the identified game face and the first jackpot number;

identifying a game face with a winning game configuration;

determining whether the game face with the winning game configuration qualifies for a jackpot award at one of the at least one elevated jackpot levels, based at least in part on one of the indicia of the winning game face and on whether the jackpot level is raised to one of the elevated levels.

2. The method of claim 1, wherein the set of indicia on each game face is arranged in a matrix.

3. The method of claim 2, wherein the matrix includes at least two rows, and wherein each of the rows includes the same number of the indicia.

4. The method of claim 3, wherein the first configuration comprises all of the indicia in at least one of the rows.

5. The method of claim 1, further comprising:

identifying a game face in which a set of the called indicia form a second configuration on a game card from the plurality of distributed game cards;

after identifying the game face with the second configuration, comparing a predetermined one of the called indicia displayed on the identified game face with a second jackpot number; and raising the jackpot level if the predetermined one of the indicia displayed on the identified game face having the second configuration matches the second jackpot number, wherein the jackpot level is raised to the second level if the jackpot level is at the first level, and wherein the jackpot level is raised to a third level if the jackpot level has previously been raised to the second level.

6. A method for playing a game of chance comprising:

distributing game cards from a set of game cards to a plurality of players, each of the game cards in the set displaying at least one game face which includes a set of indicia selected from a pool of indicia;

playing a game of chance in which the players match indicia randomly called from the pool of indicia with the indicia in a matrix of the respective game face;

identifying a game face in which a set of the called indicia form a first configuration on a game card from the plurality of distributed game cards;

determining a jackpot level from a plurality of jackpot levels based at least in part on a comparison of at least one of the indicia displayed on the identified game face with at least one jackpot number;

identifying a game face with a winning game configuration;

identifying a game face in which a set of the called indicia form a second configuration on a game card from the plurality of distributed game cards; and determining whether the game face with the winning game configuration qualifies for a jackpot award at the determined level, based at least in part on one of the indicia of the winning game face, wherein the determining of the jackpot level is based at least in part on a comparison of at least one of the indicia displayed on the identified game face having the second configuration with at least one jackpot number, and wherein the determination of the jackpot level comprises:

raising the jackpot level from a first level to a second level if the comparison of at least one of the indicia displayed on the identified game face having the first configuration with at least one jackpot number satisfies a first condition; and if the jackpot has been raised to the second level, raising the jackpot level from the second level to a third level if the comparison of at least one of the indicia displayed on the identified game face having the second configuration with at least one jackpot number satisfies a second condition.

7. The method of claim 5, wherein the first configuration is a 1 Line configuration and the second configuration is a 2 Line configuration.

8. The method of claim 6, wherein the first condition is satisfied when a jackpot number comprising an indicium drawn randomly from the set of indicia forming the first configuration matches a last indicium to be called in the first configuration, and wherein the second condition is satisfied when a jackpot number comprising an indicium drawn randomly from the set of indicia forming the first configuration matches the last indicium to be called in the first configuration.

9. The method of claim 1, wherein the at least one jackpot number comprises at least one number drawn randomly from the indicia forming the first configuration.

10. The method of claim 9 wherein the comparing includes comparing the at least one jackpot number with the last indicium to be called in the first configuration.

11. The method of claim 1, wherein the determining whether the game face with the winning game configuration qualifies for a jackpot award at the determined level includes drawing at least one indicium from the pool of indicia and determining whether any one of the at least one indicium drawn from the pool matches the last called indicium on the winning game face.

12. The method of claim 1, wherein the winning game configuration is a FULL HOUSE.

13. The method of claim 1, wherein the plurality of jackpot levels includes at least three possible jackpot levels.

14. A computer program product comprising a non-transitory recording medium encoding instructions, which when executed on a computer:

stores information on a plurality of game faces in play in a game of chance, each of the game faces comprising an arrangement of indicia selected from a pool of indicia;

calls indicia randomly from the pool of indicia;

determines when a first configuration of the called indicia is present on one of the game faces;

generates jackpot indicia;

compares at least one of the jackpot indicia with at least one of the indicia on the game face in which the first configuration is present;

determines when a second configuration of the called indicia is present on one of the game faces;

determines a jackpot level from a plurality of jackpot levels based at least in part on the comparison, wherein the determination of the jackpot level comprises:

raising the jackpot level from a first level to a second level if the comparison of at least one of the indicia displayed on the identified game face having the first configuration with at least one of the jackpot indicia satisfies a first condition; and if the jackpot has been raised to the second level, raising the jackpot level from the second level to a third level if a comparison of at least one of the indicia displayed on the identified game face having the second configuration with at least one of the jackpot indicia satisfies a second condition; and determines whether a game face with a winning game configuration is to receive a jackpot award at the determined jackpot level.

15. A gaming apparatus comprising:

a control unit which:

stores information on a plurality of jackpot levels including a first jackpot level and at least a second jackpot level;

stores information on a plurality of game faces in play in a game of chance, each of the game faces comprising an arrangement of indicia selected from a pool of indicia, calls indicia from the pool of indicia, determines when a first configuration of the called indicia is present on one of the game faces, generates jackpot indicia from among the called indicia in the first configuration on the game face with the first configuration, compares the generated jackpot indicia with a predetermined one of the called indicia on the game face in which the first configuration is present, determines a jackpot level from the plurality of jackpot levels based at least in part on the comparison, the determining including raising the jackpot level from the first jackpot level to the second jackpot level if there is a match between the predetermined one of the called indicia and the jackpot indicia, and determines whether a game face with a winning game configuration is to receive a jackpot award at the determined jackpot level; and, a display which displays the determined jackpot level.

* * * * *